US009741515B1

(12) United States Patent
Bellingan

(10) Patent No.: US 9,741,515 B1
(45) Date of Patent: Aug. 22, 2017

(54) STRUCTURES FOR REPRESENTATION OF AN OPERATIONAL STATE

(71) Applicant: Amazon Technologies, Inc., Reno, NV (US)

(72) Inventor: Carl Bellingan, Riebeek West (ZA)

(73) Assignee: AMAZON TECHNOLOGIES, INC., Reno, NV (US)

( * ) Notice: Subject to any disclaimer, the term of this patent is extended or adjusted under 35 U.S.C. 154(b) by 529 days.

(21) Appl. No.: 13/770,310

(22) Filed: Feb. 19, 2013

(51) Int. Cl.
*H01H 37/00* (2006.01)

(52) U.S. Cl.
CPC ..... *H01H 37/00* (2013.01)

(58) Field of Classification Search
CPC ..... H01H 37/00; H01H 85/04; G01D 15/10
See application file for complete search history.

(56) References Cited

U.S. PATENT DOCUMENTS 4,309,735 A * 1/1982 Morris ..... 361/100
4,603,337 A * 7/1986 Erlichman ..... 347/183
4,891,250 A * 1/1990 Weibe ..... G01K 11/16 174/255
5,776,371 A * 7/1998 Parker ..... H01H 85/30 106/272
6,077,228 A * 6/2000 Schonberger ..... 600/549
6,152,597 A * 11/2000 Potega ..... G01K 1/02 324/104
6,332,536 B2 * 12/2001 Easton ..... 206/459.5
6,396,783 B1 * 5/2002 Bell et al. ..... 369/53.18
6,488,803 B2 * 12/2002 Kiuchi et al. ..... 156/230
6,544,614 B1 * 4/2003 Huffer ..... A61J 9/02 116/200
6,832,783 B2 * 12/2004 Lawandy ..... 283/85
6,906,436 B2 * 6/2005 Jenson et al. ..... 307/116
6,985,000 B2 * 1/2006 Feder et al. ..... 324/750.05
7,086,596 B2 * 8/2006 Meier et al. ..... 235/462.25
7,169,219 B1 * 1/2007 Wynne ..... 106/31.27
7,513,682 B2 * 4/2009 McClure ..... G01K 11/12 252/408.1
7,703,291 B2 * 4/2010 Bushnik et al. ..... 62/3.2
2007/0120943 A1 * 5/2007 Van Demark ..... B41M 5/26 347/221
2008/0020165 A1 * 1/2008 Drori ..... G09F 3/0292 428/40.1

(Continued)

FOREIGN PATENT DOCUMENTS

WO WO 2012009733 A2 * 1/2012 ..... G09F 3/0292

*Primary Examiner* — Thienvu Tran
*Assistant Examiner* — Pinping Sun
(74) *Attorney, Agent, or Firm* — Eversheds Sutherland (US) LLP

(57) ABSTRACT

Structures, devices, systems, and techniques are provided to represent an operational state of an electronic device. In one aspect, a device that can represent the operational state of the electronic device can comprise a substrate configured to produce an amount of heat in response to a predetermined operational state of the electronic device, and a member thermally coupled to the substrate and having a physical property that is configurable in response to at least the amount of heat produced by the substrate. Configuration of the physical property can yield a specific physical state of the member that represents the predetermined operational state.

14 Claims, 6 Drawing Sheets

(56) References Cited

U.S. PATENT DOCUMENTS

| | | | | |
|---|---|---|---|---|
| 2008/0232427 | A1* | 9/2008 | Leute | G01K 3/005 374/161 |
| 2009/0231821 | A1* | 9/2009 | Osawa et al. | 361/767 |
| 2010/0025811 | A1* | 2/2010 | Bronner | H01L 21/67103 257/528 |
| 2010/0328019 | A1* | 12/2010 | Darr | H01H 85/30 337/227 |

* cited by examiner

STRUCTURES FOR REPRESENTATION OF AN OPERATIONAL STATE

BACKGROUND

Scaling computational resources typically results in complex computational deployments that can include a multitude of electronic devices of varied complexity, having generally rich functional relationships stemming mainly from the scaling. As a result, maintenance and service of such computational environment can entail tedious identification exercises in order to pinpoint a specific electronic component exhibiting certain operational condition or state. For example, in hard disk (HD) drive maintenance, it generally is difficult to identify a faulty HD drive in a typical deployment, let alone pinpointing a specific fault condition.

BRIEF DESCRIPTION OF THE DRAWINGS

The accompanying drawings are an integral part of the disclosure and are incorporated into the subject specification. The drawings illustrate example embodiments of the disclosure and, in conjunction with the description and claims, serve to explain at least in part various principles, features, or aspects of the disclosure. Certain embodiments of the disclosure are described more fully below with reference to the accompanying drawings. However, various aspects of the disclosure can be implemented in many different forms and should not be construed as limited to the implementations set forth herein. Like numbers refer to like elements throughout.

DETAILED DESCRIPTION

Figure 1A:
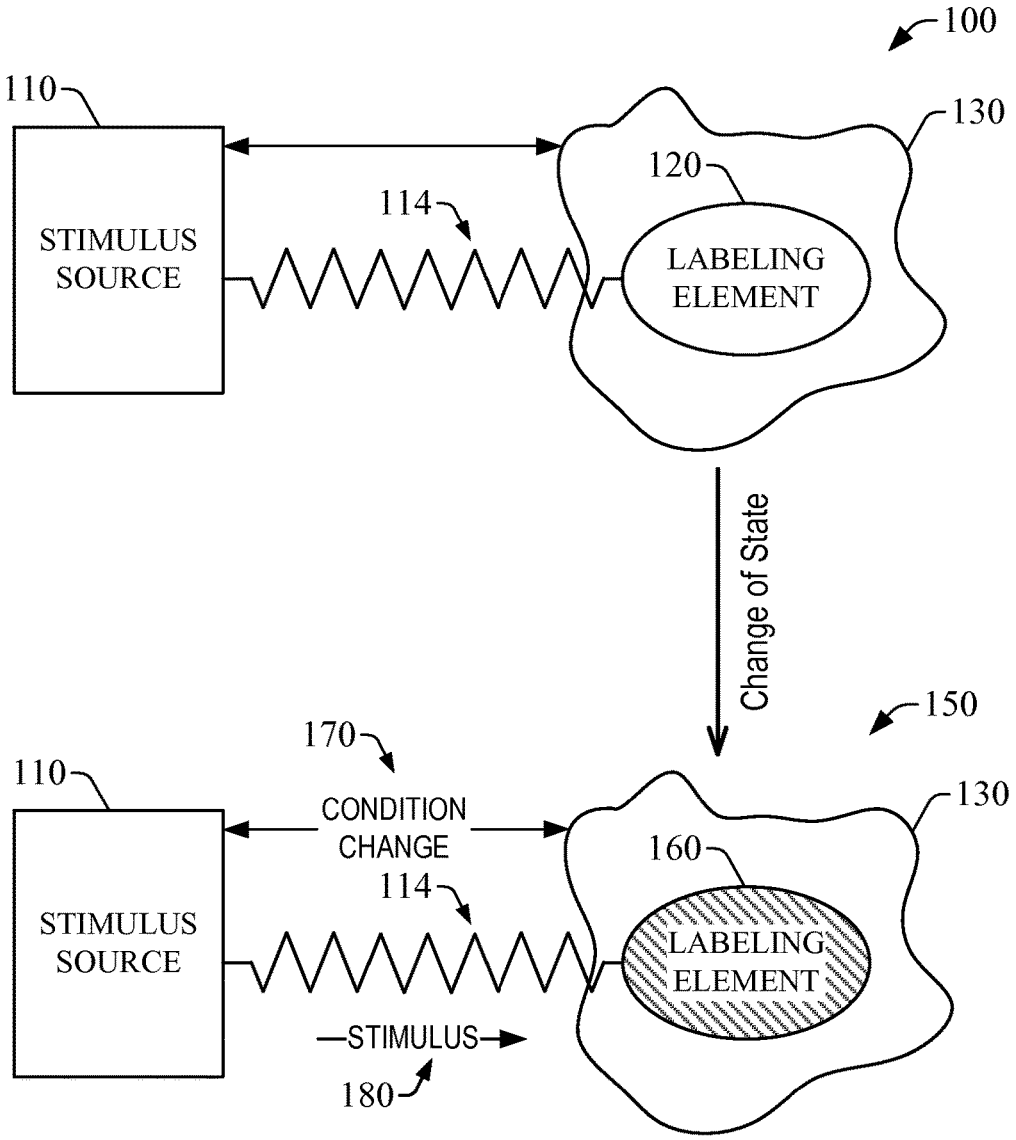
FIG. 1A illustrates an example system having a structure for representation of an operational condition in accordance with one or more aspects of the disclosure.

The disclosure recognizes and addresses, in one aspect, the issue of identification of non-functioning, or faulty, electronic devices. The disclosure provides structures, devices, systems, and/or techniques for representation of an operational condition (or operational state) of an electronic device or an electronic component (e.g., user equipment or components thereof; customer premises equipment or component(s) thereof; a network node or component(s) thereof; or the like). Such representation can be re-configurable or non-volatile. In certain embodiments, the representation of the operational condition can be accomplished via a labeling element, such as a finite solid-state thin film, having a physical property that can be configured in response to exposure to thermal energy. Specific magnitude(s) of the physical property can be representative or otherwise representative of the operational condition of the electronic component. For instance, the physical property can be or can comprise optical absorption of the labeling element, or a material that forms such element, and thus a color of the labeling element can be indicative or representative of the operational condition. In addition or in the alternative, the physical property of the labeling element can include optical emission, reflectance, surface roughness or structure (e.g., texture), or the like. In one implementation, the physical property of the labeling element can be configured in response to detection of the operational condition of the electronic component (e.g., an HD drive, a server (such as a blade server), circuitry within a motherboard, a combination thereof, or the like). In addition or in the alternative, the labeling element can be imprinted with information indicative of the operational condition or specific action to be pursued in response to such condition. A component other than the electronic component associated with the operational condition can perform such detection. In certain implementations, the operational condition can be or can comprise a fault condition of the electronic component.

At least to configure the physical property, in certain embodiments, the labeling element can be thermally coupled or otherwise in thermal contact with a heating element, such as an electrically resistive element (e.g., a resistor), that is configured to generate heat in response to an electric signal, such as an electric current transported through such element. In response to generation of certain amount of heat and transfer of at least a portion thereof to the labeling element, the physical property can adopt a specific magnitude that modifies a physical appearance of a material (e.g., a plastic, a ceramic, a glass, or the like) that forms the labeling element or a product (e.g., paper; electronic paper (such as an electrochromic thin-film passive display, an electrophoretic thin-film passive display; and the like) that embodies or comprises the labeling element. Such a modification can yield a modified physical state, and ensuing modified physical appearance, of the labeling element that can be indicative or otherwise representative of the operational condition (e.g., a fault condition). Accordingly, it should be appreciated that the labeling element can be switched or caused to switch from a physical state representative of an operational condition (e.g., functioning state) to another physical state representative of another operational condition (e.g., fault state). For certain labeling elements, or material(s) that compose such elements, the disclosure can permit irreversible switching from a first physical state to a second physical state in response to detection of a transition from a first operational condition to a second operational condition. Thus, in one aspect, the disclosure permits a persistent, or non-volatile, representation of an operational state of an electronic component.

Representation of an operational state via a physical appearance of a labeling element can permit visual inspection of the operational state of an electronic component having or otherwise being associated with the labeling element. In scenarios in which irreversible switching of a physical state or related physical property and/or chemical property is permitted in response to detection of a fault condition of the electronic component, the non-volatile nature of the physical appearance of the labeling element can permit straightforward identification of the electronic component as a faulty component. Straightforward identification of a faulty component can simplify maintenance or service of electronic components. In addition, accurate identification of a faulty component can permit reduction of costs (e.g., expenditure of monetary and time resources) associated with servicing a misidentified or misrepresented electronic component.

It should be appreciated that while optical properties, such as optical absorption, optical emission, or reflectance, are utilized to describe and illustrate the various features of the disclosure, the disclosure is not so limited and other configurable or substantially permanently (or irreversibly) switchable physical and/or chemical properties can be contemplated. Such properties can include, for example, sublimation pressure, which can determine, in part, the scent of a labeling element; surface roughness or structure (also referred to as texture); and the like. In one aspect, for ease of implementation, configurable physical properties and/or chemical properties that change the appearance of a material that forms a labeling element of the disclosure can be contemplated. It should further be appreciated that while the disclosure is illustrated in connection with labeling elements having a physical state and ensuing physical appearance that is responsive to certain amounts of heat, other labeling elements having respective physical appearances based at least on one or more stimuli other than thermal energy can be contemplated. For instance, a labeling element formed from one or more materials having physical properties responsive to electromagnetic radiation, such as photoresistive or fluorescent material, also can be utilized in the disclosed devices. Access to labeling elements having physical properties responsive to various stimuli can permit rich customization with respect to the electronic components for which certain operational properties are identified or otherwise represented.

Referring to the drawings, FIG. 1A illustrates an example system 100 having a structure for representation of an operational condition in accordance with one or more aspects of the disclosure. The structure can comprise a labeling element 120 (also referred to as labeling member 120) that has a specific physical state and related physical appearance, such as color, scent, texture, a combination thereof, or the like. Such state and related appearance can be associated with a specific condition of a structure 130 that is coupled or attached to the labeling element 120. The specific condition can be or can include an operational condition (satisfactory state, non-satisfactory operating state, fault state, or the like); a supply chain state (e.g., intake product, ready-to-ship product, shipped product, catalogued product, or the like); a manufacturing state (e.g., finished product, accepted product, or the like); or the like. In certain embodiments, the labeling element 120 can have a size that is suitable or otherwise configured to be read by a machine (automated or autonomous, for example) or a human agent. For instance, the labeling element 120 can have a typical length from about 0.25 inches to about 1.0 inch, or a typical surface of about 1.0 inch squared.

In addition, the structure can comprise a coupling medium 114 that permits functional coupling of the labeling element 120 to a stimulus source 110 that can impart or otherwise exert a stimulus onto the labeling element 120. The stimulus source 110 can be functionally coupled (e.g., communicatively coupled) with the structure 130 or a functional element therein. The stimulus generated by the stimulus source 110 can be generated, at least in part, in accordance with one or more phenomena including thermodynamics, electromagnetism, mechanics, a combination thereof, or the like. Accordingly, in one aspect, the functional coupling between the labeling element 120 and the stimulus source 110 can be embodied in or can comprise thermal coupling, electromagnetic coupling, mechanical coupling, electromechanical coupling, a combination thereof, or the like. At least to permit such a functional coupling, in one aspect, the coupling medium 114 can be embodied in or can comprise a medium having specific physical, chemical, or physicochemical properties (such as thermal conductivity, electrical resistivity, permeability, susceptibility, or the like) that can be specific to a particular stimulus that can be imparted from or otherwise exerted by the stimulus source 110 onto the labeling element. In one aspect, the functional coupling between the labeling element 120 and the stimulus source 110 can be based at least in part on the type of stimulus, and can be suitably embodied in a medium that permits transporting or otherwise transferring the stimulus from the stimulus source 110 to the labeling element 120. As an example, for an electric stimulus, such as an electric current or an applied voltage or electric field, the coupling medium 114 can be embodied in or can comprise a conductor. As another example, for magnetic stimulus, such as an applied magnetic field, the coupling medium 114 can be embodied in or can comprise a magnetic material (e.g., a ferromagnetic material or an anti-ferromagnetic material) or a semi-magnetic material. As yet another example, for a thermal stimulus, such as heat, the coupling medium can comprise a material with a suitable thermal conductivity (e.g., a high thermal conductivity). In still another example, for a mechanical stimulus, such as hydrostatic pressure, torsion or a vibration, or the like, the coupling medium 114 can comprise an elastic solid medium. It should be appreciated that, in certain embodiments, the stimulus that is exerted or applied to the labeling element 120 can be a resultant stimulus that is caused by application of a precursor stimulus. For instance, application of an electric current (which is an electric stimulus) can result in an amount of heat (which is a thermal stimulus) at a portion of the coupling element 114.

A stimulus 180 can be applied in response to a change of state of the structure 130 or a functional element therein (e.g., an electronic component contained in the structure 130). In addition, in response to application of the stimulus (e.g., electric current and/or heat) to the labeling element 120, a physical property, a chemical property, or a physicochemical property of the labeling element 120 can be modified, with the ensuing alteration on the physical state of the labeling element 120. A modification of the physical state of the labeling element 120 can yield a modified labeling element, referred to as labeling element 160, having a different appearance from that of the labeling element 120. The different appearance (depicted with hash lines) of the labeling element 160 can represent a condition associated with the changed state of the structure 130 or the functional element therein. As illustrated in example system 150, which is the system that results from the example system 100 in response to the changed state, the stimulus source 110 can detect or otherwise identify a condition change 170 in the structure 130 or a functional element therein and, in response, can supply (e.g., apply, exert, or the like) a stimulus 180 to the labeling element coupled or otherwise attached to the structure. As described herein, in response to the stimulus 180, the labeling element 120 can adopt a modified appearance yielding a labeling element 160 that is indicative or otherwise representative of the changed state.

In certain embodiments, the labeling element 120 can contain state information indicative or otherwise representative of a predetermined condition (e.g., failure or fault state) that may be associated with a change of appearance of the labeling element 120. In addition or in the alternative, procedural information indicative of a group of actions that can be implemented in response to the presence of the predetermined condition can be contained in the labeling elements 120. Accordingly, in one embodiment, for example, a transition from a first condition of an electronic component associated with the structure 130 (e.g., a component contained within the structure 130) to a second condition of such component can result in a transition from labeling element 120 to labeling element 160, where the labeling element 160 can convey at least a portion of the state information or at least a portion of the procedural information.

The state information and/or the procedural information can be embodied in indicia imparted to or otherwise placed on a portion of the labeling element 120. At least a portion of the indicia can be embodied in or can comprise a universal product code (UPC) or any type of one-dimensional barcode symbols, a matrix code (which can be embodied in a Quick Response (QR) code) or any type of two-dimensional barcode. The manner in which the indicia is imparted or placed on the labeling element 120 can be specific to the material that forms the labeling element 120. In an example embodiment in which the labeling element 120 is formed or otherwise contains conventional paper, the indicia can be imparted or placed by printing onto the labeling element 120. In an embodiment in which the labeling element 120 is formed or otherwise contains an electronic paper, the stimulus source 110 can transmit a signal to configure or otherwise cause the labeling element 160 to render (e.g., display) at least a portion of the indicia indicative or representative of the state information and/or the procedural information. In one aspect, the rendering can be responsive to the change of physical state of the electronic paper. For yet another example, in an embodiment in which the labeling element 120 is formed or otherwise contains a solid thin film or solid substrate, the indicia can be imparted or placed by etching or otherwise engraving a surface of the labeling element 120.

Figure 1B:
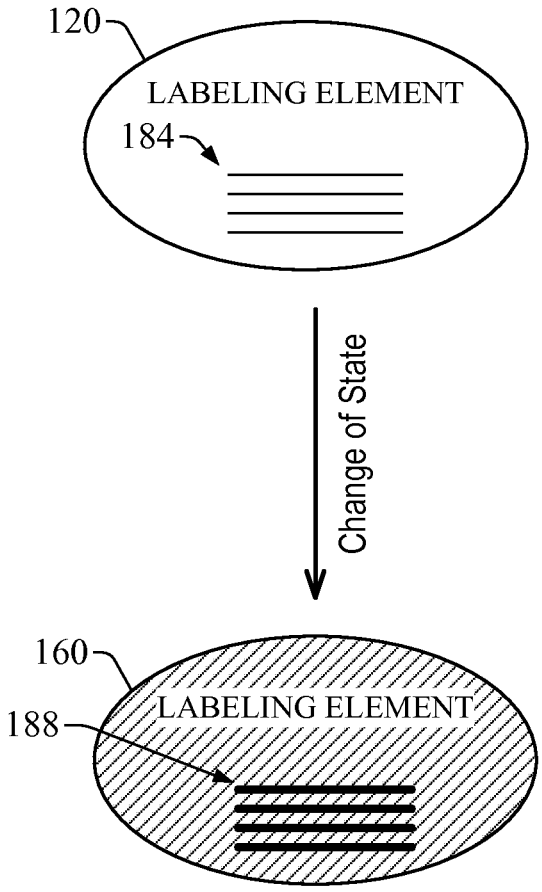
FIG. 1B represents example indicia that can be located on a surface of the structure shown in FIG. 1A.

As illustrated in FIG. 1B, the indicia 184, which is represented with lines, can be located on a surface of the labeling element 120. In response to a change of state of the structure 130 or a functional element associated with (e.g., contained in, integrated into, or coupled to, etc.) the structure 130, the indicia 184 can be modified into indicia 188, which can be more prominently rendered that the precursor indicia 184 and/or can convey additional information with respect to the information conveyed by the indicia 84. In one aspect, the indicia 184 can be representative or otherwise indicative of state information, whereas the indicia 188 can include such information and information indicative or otherwise indicative of procedural information associated with a condition conveyed by the state information. For instance, the state information can be indicative of a fault condition and the procedural information can be indicative or otherwise representative of a procedure to resolve or otherwise address the fault condition.

Figure 2:
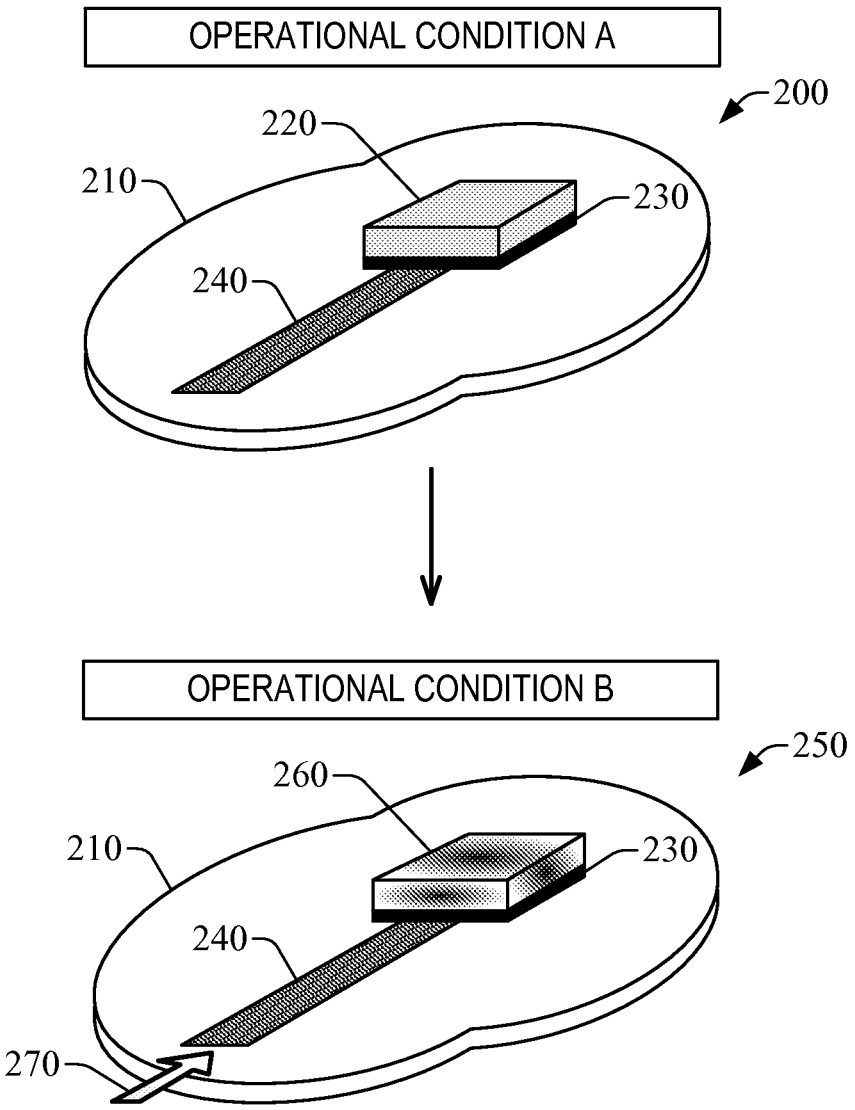
FIG. 2 presents an example structure for representation of an operational condition in accordance with one or more aspects of the disclosure.

FIG. 2 illustrates an example structure for representation of an operational condition in accordance with one or more aspects of the disclosure. As illustrated, the structure 200 can comprise a substrate 210 (e.g., a solid-state substrate) configured to supply an electric signal, such as electric current. In one aspect, the solid-state substrate 210 can be contained within circuitry of an electronic component (not shown) or can be attached or otherwise coupled to a surface of a structural member (e.g., a housing) coupled to the electronic component. The electronic component can be contained in an electronic computing device, such as a server or a router. A conducting member 240 (also referred to as a conducting element 240) that is coupled to the substrate 210 can permit transport of the electric signal and, thus, can configure the substrate 210 to supply the electric signal. The conducting member 240 can formed from substantially any conducting material, such as metals, metal alloys, doped semiconductors, combinations thereof, or the like. The electric signal can be supplied to a heating member 230 (also referred to as heating element 230) in response to a predetermined operational condition of an electronic component associated to with the structure 100. For example, the operational condition can include a fault condition, a high processing load condition, a near-threshold condition for a computing resource (such as available memory), or the like. The heating member 230 is attached to the substrate 210 and is thermally coupled or otherwise in thermal contact with a labeling element 220. In addition, the heating member 230 can generate an amount of heat in response to at least a portion of the electric signal (e.g., the electric current). As illustrated, the heating member 230 can be spatially localized and thus can be configured to generate the amount of heat at a localized region of the solid-state substrate 210. Accordingly, in one aspect, the heating member 230 can produce heat at targeted locations in the substrate 210. In certain embodiments, the heating member can comprise an electrically resistive member (e.g., a resistor) that can generate the amount of heat in response to at least a portion of the electric signal being transported through the electrically resistive member.

In certain embodiments, the labeling member 220 can be attached to or otherwise assembled with the heating member 230 in a manner that permits thermal contact between such elements. For example, the labeling member 220 can be removably attached to the heating member 230 in a region spanning at least a portion of the localized region occupied by the heating element 230. In the example structure 200, as an illustration, the heating member 230 and the labeling member 220 form a substantially planar interface. In certain implementations, the labeling member 220 can be embodied in or can comprise a flexible solid-state film (e.g., a polymer or certain plastic) and can be suitably attached to the heating member 230 in order be peeled off there from, and thus from the solid-state substrate. In other implementations, the labeling member 220 can be coated or otherwise deposited onto a surface of the heating element 230, forming a monolithic solid structure. Such coating can be effected in a manner suitable for removal or release from the heating element 230, and thus the solid-state substrate.

It should be appreciated that coating the labeling member 220 onto the heating element 230, and coating the heating element 230 onto the solid-state substrate 210 in scenarios in which such substrate is embodied or comprises a chipset of an electronic component can form a monolithic structure that permits labeling the electronic component that contains the solid-state substrate 210.

In one aspect, the labeling member 220 can have at least one physical property that can determine a physical state of the labeling member 220 and can be configurable—e.g., reversibly switchable or irreversibly switchable—in response to at least the amount of heat generated by the heating member 130. The at least one physical property can comprise optical absorption, which can define, at least in part, a color of the labeling element 220. As illustrated in FIG. 2, the labeling member 220 in the structure 200 can be in a physical state associated with a first operational condition (labeled "condition A" in FIG. 2) of the electronic component (not shown in FIG. 2) that can contain the solid-state substrate 210. In a scenario in which the electronic component changes to a second operational condition (labeled "condition B" in FIG. 2), an electric signal 270 (e.g., an electric current) can be transmitted to the heating element 230 via the conducting member 240. The heating element 230 can receive the electric signal and, in response, can generate heat based at least in part on at least a portion of the electric signal. The magnitude of the electric signal 270 can be specific to one or more of the electronic components or a material of the labeling member 220. In one aspect, the material of the labeling member 220, or any labeling element described herein can be or can include a conductor, such as tungsten or copper, or a conducting alloy (e.g., a nickel-chromium alloy or a nickel-chromium-iron alloy, both of which can be generally referred to nichrome). In certain embodiments, for example, the labeling member 220 can include or can be embodied in a wire of one or more of the foregoing material(s) deposited or otherwise attached onto a ceramic substrate. In other embodiments, for example, the labeling member 220 can be embodied in or can include a portion of a printed circuit board having a track of copper (or other metal or conductor) deposited or otherwise attached onto a fiberglass base. It would be readily apparent that one advantage of such embodiments may be that the wire and/or track can be designed or otherwise arranged to have a a shape that can convey a message in response to the labeling being stimulated (e.g., heated and burned). In one aspect, the magnitude of the electric signal is suitable for the heating member 230 to produce an amount of heat effective to alter the physical state, and ensuing physical appearance, of the labeling member 220 from the first physical state to a second physical state. In embodiments in which the labeling member 220 is embodied in or includes thermal paper, the amount of heat can have a magnitude suitable to elevate the temperature of the paper to a temperature that is nearly or greater than about 200 degrees Fahrenheit (° F.). It should be appreciated that such temperature bound can vary according to the materials employed to manufacture the thermal paper.

Switching from the first physical state to the second physical state result from a change in the at least one physical property of the labeling member 220 that is response to thermal energy. As illustrated, in the second physical state the labeling member switches to another labeling member 260 having a physical appearance (e.g., color) specific to the second physical state. Thus, in one aspect, the structure 250 also is specific to the second physical state. Accordingly, in one aspect, in response to the electric signal 270, the labeling member 260 can represent the operational "condition B" of the electronic component associated with the structures 200 and 250.

In an example scenario in which the "condition A" represents normal operation (or normal state) of an electronic component associated with the substrate 210, and "condition B" represents a fault condition, the labeling member 260 can be removed and replaced with labeling member 220 after the electronic component has been serviced. Such replacement may be avoided in scenarios in which the physical state associated with the "condition B" can be reversibly configured. For instance, in an embodiment in which the labeling member 220 includes a passive display having electrophoretic ink (e-ink), or electronic ink, the labeling member 220 can be reset or reinitialized after the electronic component has been serviced or otherwise repaired.

Figure 3:
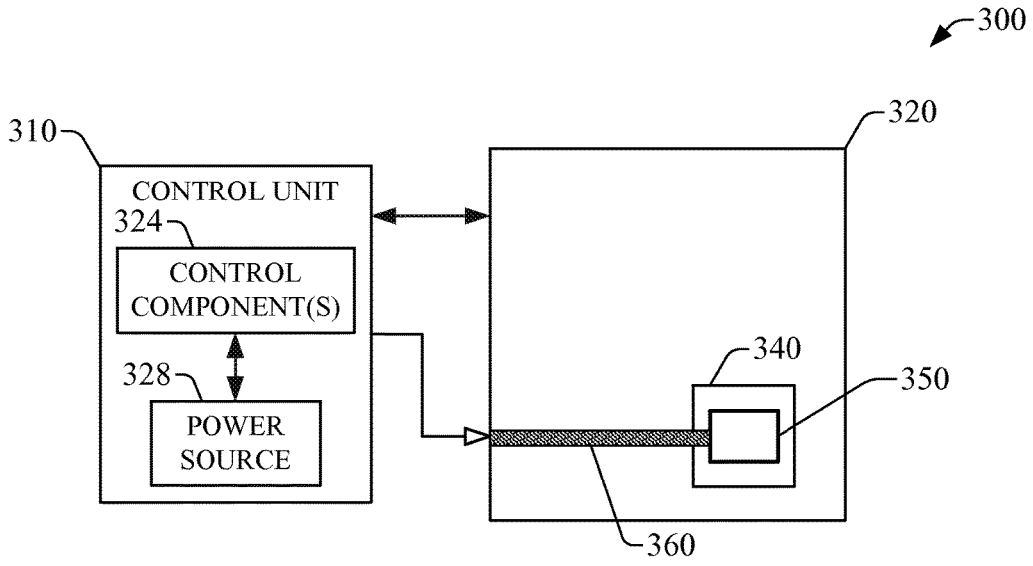
FIGS. 3-4 illustrate example operational environments in accordance with one or more aspects of the disclosure.

FIG. 3 presents a block diagram of an example system 300 having a solid-state device that can permit representation of an operational state of at least one electronic component in accordance with one or more aspects of the disclosure. Open arrows indicate that additional structure may be included in order to exchange information between the control unit 310 and the electronic computing device 320. The example system 300 comprises an electronic computing device 320 having an electronic component 340 (e.g., a HD drive, a computing processing unit, a graphical processing unit, a video card, a storage device, or the like). The electronic component 340 can have a surface that is coupled to a heating member (not shown). For instance, the heating member can be glued or otherwise mounted to the surface, which can embody the solid-state substrate 210. As described herein, the heating member can be electrically coupled (e.g., soldered) to a conducting member 360 (e.g., conducting wires or other portions of conductors, such as metals or metal alloys), and can be thermally coupled to a labeling member 350. In one aspect, the heating member (not depicted) and the conducting member 360 can embody the coupling medium 114, particularly, yet not exclusively, for stimuli generated from electrical phenomena.

Figure 5:
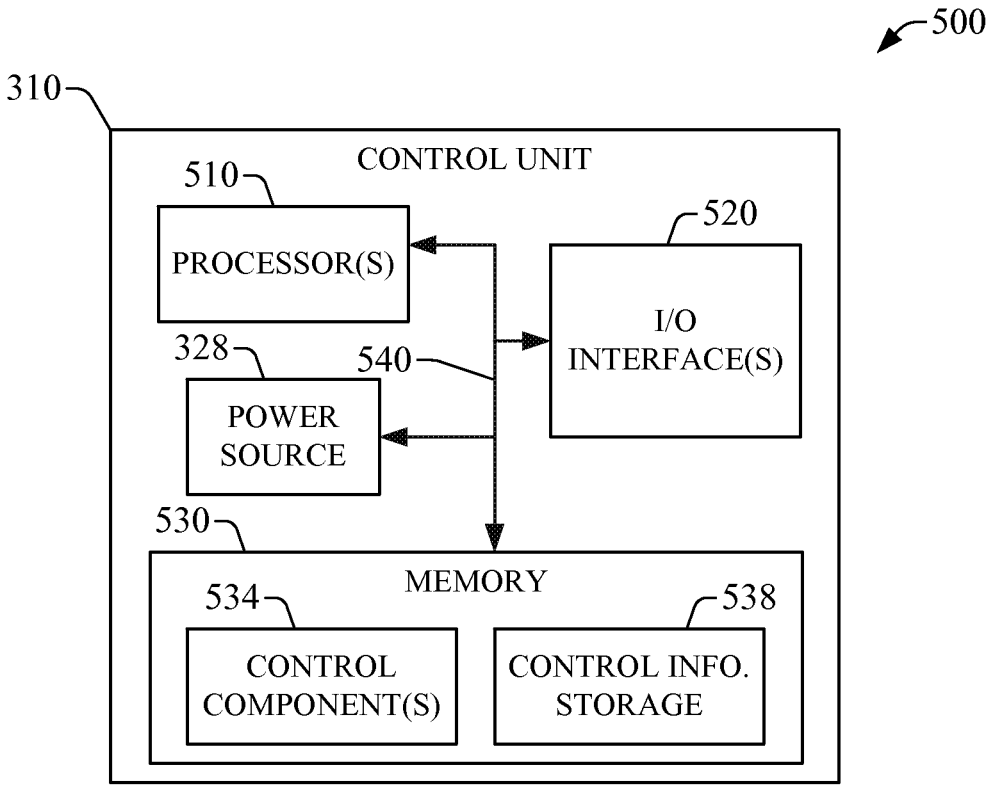
FIG. 5 illustrates an example control unit in accordance with one or more aspects of the disclosure.

As illustrated, the example system 300 also can comprise a control unit 310 functionally coupled (e.g., communicatively coupled) to the electronic computing device 320. The control unit 310 can include one or more control component(s) 324 and a power source 328. The control unit 310, via at least one component of the control component(s) 324 can monitor operational state of the electronic component 340. For instance, the control unit 310, via the at least one component, can collect or otherwise access information (e.g., data, metadata, and/or signaling) indicative of specific performance metrics of the electronic component 340, and can compare at least a portion of the information with one or more predetermined metrics, such as one or more specific key performance indicators (KPIs) and/or predetermined values of certain signaling, or the like. In one embodiment, e.g., embodiment 500 shown in FIG. 5, the control unit 310 can include one or more I/O interfaces 520 that permit exchange of information (e.g., data, metadata, and/or signaling) with the electronic computing device 320 or a component thereof. In other embodiments, the control unit 310 can be embodied in or contained within a computer server or a rack-mountable unit that can be functionally coupled to the electronic computing device 320 via at least one of the I/O interface(s) 520. In one aspect, the one or more I/O interfaces 520 can include one or more connectors or ports, including parallel ports (e.g., General Purpose Interface Bus (GPIB), IEEE-1284), serial ports (e.g., Recommended Standard (RS)-232, V.11, Universal Serial Bus (USB), FireWire or IEEE-1394, or the like), Ethernet ports, V.35 ports, X.21 ports, or dry contacts.

Information received via at least one of the I/O interface(s) 520 can be analyzed or otherwise processed by at least one of the processor(s) 510. In one aspect, such analysis or processing can permit the control unit 310 to monitor the operational state of the electronic component 340. In one aspect, the analysis can comprise comparison of at least a portion of accessed information with at least one metric of the one or more metrics. Based on the analysis of information indicative of performance of the electronic component 340, the control unit 310 can determine the presence of a specific operational state, such as a fault state, of the electronic component 340. Determination of such presence can be referred to as detection of the specific operational state.

In response to detection of a predetermined operational state of the electronic component 340, the control unit 310 can direct the power source 328 to supply an electric signal (e.g., an electric current) to the heating element thermally coupled to the electronic component 340. Accordingly, in one aspect, the control unit 310 can embody the stimulus source For instance, to direct the power source 328 in such manner, the control unit 310 can transmit an instruction to the power source 328, or can configure a predetermined output voltage (via one of the I/O interface(s) 520, for example) that can be injected into the power source 328 in order to configure it to supply the electric signal. While the power source 328 is integrated into the control unit 310, embodiments in which the power source 328 is integrated into the electronic computing device 320 also are contemplated.

The power source 328 can power up components or functional elements within the control unit 310. In certain embodiments, the power source 328 can be a rechargeable power source, e.g., a rechargeable battery, and it can include one or more transformers to achieve a power output level suitable for operation of the control unit 310 and/or for production and transmission of an electric current or any other electrostatic or electromagnetic stimulus. In one aspect, the power source 328 can include an I/O interface (e.g., one of the network adapter(s) 518) to connect operationally to a power grid. In another aspect, the power source 328 can include an energy conversion component, such as a solar panel, to provide additional or alternative power resources or autonomy to the control unit 310.

As described herein, the electric signal that can be supplied by the power source 328 can be specific to the heating element attached to the electronic component 340. In response to reception of the electric signal the heating element can generate an amount of heat suitable to switch the physical state (e.g., modify at least one physical property) of the labeling member 350 (which can embody labeling element 220, for example). In response, in one aspect, the labeling member 350 can switch from a first physical state to a second physical state, with the ensuing change in physical appearance (e.g., a change of color). The labeling element 350 in the switched physical state represents the predetermined operational state of the respective electronic component.

At least the analysis or processing, and related detection, can be performed in response to execution of one or more machine-accessible instructions (e.g., computer-readable instructions and/or computer executable instructions) retained in one or more memory elements in a memory 530 by the at least one processor. The one or more machine-accessible instructions can embody or can include control logic for operation of the control unit in accordance with one or more aspects described herein. Accordingly, in one aspect, such machine-accessible instruction(s) can be referred to as control instruction(s), which embody or comprise one or more software components. The memory element(s) containing the machine-accessible instruction(s) are represented as control component(s) 534. The one or more machine-accessible instructions contained within the control component(s) 534 can comprise various programming code instructions according to programming languages of varied complexity (assembler, ladder logic, high-level programming language, etc.) and suitable for execution by at least one of the processor(s) 510. It should be appreciated that the one or more software components can render the control unit 310, or any other computing device that contains such components, a particular machine for detection and application of a stimulus as described herein, among other functional purposes.

Figure 6:
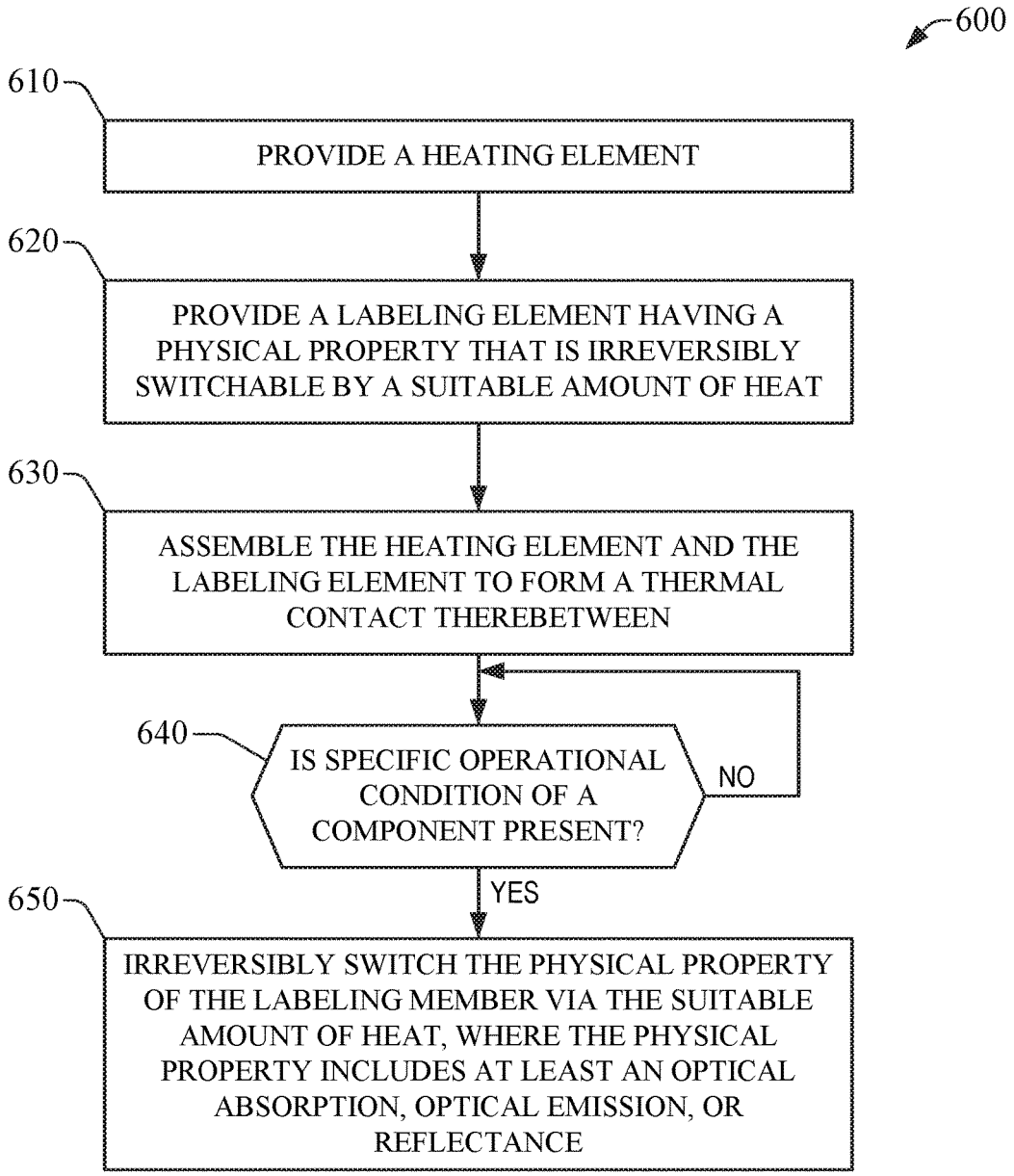
FIG. 6 illustrates an example method in accordance with one or more aspects of the disclosure.

In one scenario, for example, at least a portion of the control instructions can embody a portion of the example method presented in FIG. 6. For instance, to embody such a method, at least the portion of the control instructions can be persisted (e.g., encoded) in a computer-readable non-transitory storage medium and executed by a processor. The one or more computer-accessible instructions that embody a software component can assembled into one or more program modules, for example, that can be compiled, linked, and/or executed at the control unit 310 or other computing devices. Generally, such program modules comprise computer code, routines, programs, objects, components, information structures (e.g., data structures and/or metadata structures), etc., that can perform particular tasks (e.g., one or more operations) in response to execution by one or more processors, which can be integrated into the control unit 310 or be functionally coupled thereto.

As illustrated and described herein, the control unit 310 can comprise one or more processors 510, one or more I/O interfaces 520, a memory 530, and a bus architecture 540 (also termed bus 540) that can functionally couple various functional elements of the control unit 310. The bus 540 can include at least one of a system bus, a power bus, a memory bus, an address bus, or a message bus, and can permit exchange of information (data, metadata, and/or signaling) between the processor(s) 510, the input/output (I/O) interface(s) 520, and/or the memory 530, or respective functional element therein.

The I/O interface(s) 516 permit communication of information between the control unit 310 and an electronic device, such as another the electronic computing device 320. Such communication can include direct communication or indirect communication, such as exchange of information between the control unit 310 and the electronic device via a network or elements thereof. As illustrated, the I/O interface(s) 516 can comprise one or more of rendering units (not shown) can include functional elements (e.g., lights, such as light-emitting diodes; a display, such as liquid crystal display (LCD), combinations thereof, or the like) that can permit control of the operation of the control device 310, or can permit conveying or revealing operational conditions of the control unit 310.

In one aspect, the bus 540 represents one or more of several possible types of bus structures, including a memory bus or memory controller, a peripheral bus, an accelerated graphics port, and a processor or local bus using any of a variety of bus architectures. As an illustration, such architectures can comprise an Industry Standard Architecture (ISA) bus, a Micro Channel Architecture (MCA) bus, an Enhanced ISA (EISA) bus, a Video Electronics Standards Association (VESA) local bus, an Accelerated Graphics Port (AGP) bus, and a Peripheral Component Interconnects (PCI), a PCI-Express bus, a Personal Computer Memory Card Industry Association (PCMCIA), Universal Serial Bus (USB) and the like. The bus 213, and all buses described herein can be implemented over a wired or wireless network connection and each of the subsystems, including the processor(s) 510, the memory 530 and memory elements therein.

The control unit 310 can comprise a variety of computer-readable media. Computer readable media can be any available media (transitory and non-transitory) that can be accessed by a computing device. In one aspect, computer-readable media can comprise computer non-transitory storage media (or computer-readable non-transitory storage media) and communications media. Example computer-readable non-transitory media can be any available media that can be accessed by the control unit 310, and can comprise, for example, both volatile and non-volatile media, and removable and/or non-removable media. In one aspect, the memory 530 can comprise computer-readable media in the form of volatile memory, such as random access memory (RAM), and/or non-volatile memory, such as read only memory (ROM).

It should be appreciated that, in one aspect, a processor of the processor(s) 514 that executes one or more control instructions can retrieve information from or retain information in a memory 530 in order to operate in accordance with the functionality programmed or otherwise configured by control component(s) 536. Such information can include at least one of code instructions or other signaling, information structures, or the like. In certain embodiments, at least one of the one or more interfaces 520 can permit or facilitate communication of information between two or more components within the control component(s) 534. The information that is communicated by the at least one interface can result from implementation of one or more operations in a method of the disclosure. In certain embodiments, one or more of the control component(s) 534 and/or the control information (info.) storage 538 can be embodied in or can comprise removable/non-removable, volatile/non-volatile computer storage media.

At least a portion of at least one of the control component(s) 536 or the control information (info.) storage 538 can program or otherwise configure one or more of the processors 514 to operate at least in accordance with the functionality described herein.

In addition, the memory 530 can comprise computer-accessible instructions and information (e.g., data and/or metadata) that permit or facilitate operation and/or administration (e.g., upgrades, software installation, any other configuration, or the like) of the control unit 310. Accordingly, the memory 530 can contain one or more program modules that embody or include one or more OSs, such as Windows operating system, Unix, Linux, Symbian, Android, Chromium, and substantially any OS suitable for mobile computing devices or tethered computing devices. In one aspect, the operational and/or architecture complexity of the control unit 310 can dictate a suitable OS. The memory 530 also can comprise data and/or metadata that can permit or facilitate operation and/or administration of the control unit 310.

It should be recognized that while the control component(s) 536 and other executable program components, such as OS instruction(s), are illustrated herein as discrete blocks, such software components can reside at various times in different memory components (not shown) of the control unit 310, and can be executed by at least one of the processor(s) 510.

As described herein, the control unit 310 can include the power source 328, which can power up components or functional elements within such unit, and can supply an electric current, or any other electrostatic or electromagnetic stimulus.

Various systems similar to the example system 300 can be produced by attaching several heating members thermally coupled to respective labeling members to several structural members in a system of electronic devices. Each of the heating members thermally coupled to respective labeling members can form a labeling device (or tagging device) that can represent an operational state of electronic components associated with the several structural members.

In certain embodiments, a system that permits representation of an operational state of one or more electronic components can comprise a plurality of structural members, where each of the structural members can be associated with a respective component of the one or more electronic components. In addition, the system can include a plurality of heating members attached to the plurality of structural members. In one aspect, each heating member of the plurality of heating members can be attached to a respective structural member of the plurality of structural members. In another aspect, at least one heating member of the plurality of heating members can be configured to generate an amount of heat in response to a predetermined operational condition of at least one electronic component associated with the plurality of structural members. In one implementation, each of the heating elements can comprise an electrically resistive element (e.g., a resistor) that can produce heat in response to receiving an electric signal (e.g., an electric current) in response to such predetermined operational condition, such as a fault condition, a high processing load condition, a near-threshold condition for a computing resource (such as available memory), or the like). The system also can comprise a plurality of labeling members that are thermally coupled to the plurality of heating members. In one aspect, as described herein, each labeling member of the plurality of labeling members can have at least one physical property that is configurable—e.g., reversibly configurable or irreversibly configurable—in response to at least the amount of heat generated by the at least one of the plurality of heating elements.

Figure 4:
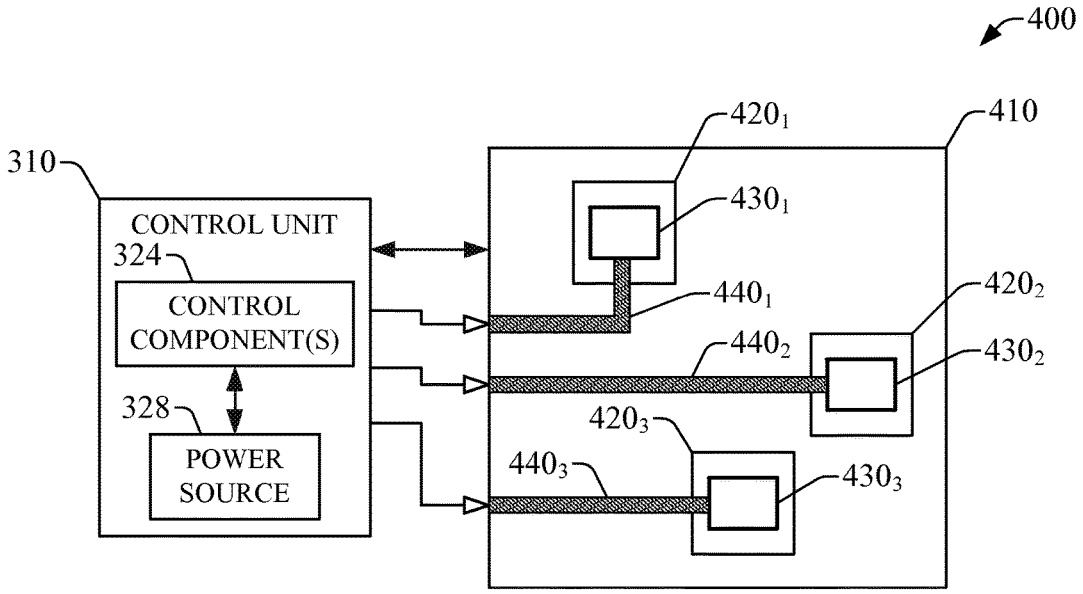

As an illustration, FIG. 4 presents a block-diagram of an example system 400 having a plurality of solid-state devices that can permit representation of an operational state of at least one electronic component in accordance with one or more aspects of the disclosure. The example system 400 comprises an electronic computing device 410 having three electronic components $\mathbf{420}_1$-$\mathbf{420}_3$ (e.g., a HD drive, a computing processing unit, and storage device). Open arrows indicate that additional structure may be included in order to exchange information between the control unit 310 and the electronic computing device 410. A group of three heating members (not shown) can be attached (e.g., glued or otherwise mounted) to respective surfaces of each of the electronic components $\mathbf{420}_1$-$\mathbf{420}_3$. Each of the heating members can be electrically coupled to respective conducting members $\mathbf{440}_1$-$\mathbf{440}_3$ (e.g., conducting wires or other portions of conductors, such metals or metal alloys). In response to detection of a predetermined operational state of at least one the electronic component $\mathbf{420}_1$-$\mathbf{420}_3$, the control unit 310 can direct (e.g., transmit an instruction to, or configure a predetermined output voltage or other electric signal at) the power source 328 to supply an electric signal (e.g., an electric current) to each heating element respectively attached to the electronic component of the at least one electronic component $\mathbf{420}_1$-$\mathbf{420}_3$ having the predetermined operational state. As described herein, the electric signal can be specific to the heating element that receives it. In response to reception of the electric signal the receiving heating element generates an amount of heat suitable to switch the physical state (e.g., modify at least one physical property and/or chemical property) of the respective labeling member $\mathbf{430}_1$-$\mathbf{430}_3$. As a result, in one aspect, the labeling element that is excited via the amount of heat can switch from a first physical state to a second physical state, with the ensuing change in physical appearance. The labeling element in the switched physical state represents the predetermined operational state of the respective electronic component.

In certain embodiments, the control unit 310 can be housed in a hardware device (e.g., a dongle) configured to attach or couple to the electronic computing device 320. In such embodiments, the power source 328 may not be integrated into the control unit 310, which can leverage a power source or power supply present or functionally coupled to the electronic computing device 320. In addition, the I/O interface(s) 520 can include a port, such as a USB port, configured to attach or that can permit attachment of the hardware device to the electronic computing device 320. In one of such embodiments, the control information storage 538 can include location information indicative or otherwise representative of distribution (or respective locations) of a plurality of labeling members (e.g., $430_1$-$430_3$) within an electronic computing device (e.g., electronic computing device 410). In addition, in response to detection of a predetermined condition (e.g., a fault condition) at a functional element (e.g., a HD drive, a server, a router or gateway, a component, or the like) of the electronic computing device, identification information indicative of such functional element can be retained at the control information storage 538. The identification information can be collected or otherwise extracted from the control unit 310 via at least one of the I/O interfaces 520 (e.g., a USB port, or a predetermined group of pins). Availability of both the location information and the identification information can permit efficient (e.g., precise, cost effective) servicing of an arrangement of functional elements tagged by (or coupled to) respective labeling elements having their locations retained in the location information.

It should be appreciated that such hardware device embodiments in combination with the disclosed structures having a coupling medium (e.g., medium 114) and a labeling element (e.g., labeling element 120) can permit implementing (e.g., retrofitting) legacy electronic computing devices.

In view of the aspects described herein, an example of the various methods that can be implemented in accordance with the disclosure can be appreciated with reference to the flowchart in FIG. 6, which represents an example method for identifying an operational condition of a component (e.g., a server, a hard disk drive, a motherboard, or the like) in accordance with one or more aspects of the disclosure. For purposes of simplicity of explanation, the example method 600 is presented and described as a series of blocks (with each block representing an action or an operation, for example). However, it is to be understood and appreciated that such method is not limited by the order of blocks and associated actions or operations, as some blocks may occur in different orders and/or concurrently with other blocks from that are shown and described herein. In addition, not all illustrated blocks, and associated action(s), may be required to implement the example method 600 in accordance with one or more aspects of the disclosure. While the example method 600 is described in connection with a heating element and heat as a stimulus to a labeling element, other coupling media and associated stimuli can be contemplated in accordance with at least certain aspects of the disclosure.

At block 610, a heating element is provided. As described herein, the heating element (e.g., member 130) can comprise an electrically resistive element (such as a conductor). At block 620, a labeling element (e.g., element 120 or member 220) having a physical property that is irreversibly switchable by a suitable amount of heat is provided. It should be appreciated that, in one or more embodiments, the physical property can be configurable (e.g., reversible switchable) rather than irreversibly switchable. In certain embodiments, the physical property can include an optical property of a material forming the labeling member. The optical property can be or can include optical absorption, optical emission (e.g., stimulated emission or fluorescence), or optical reflectance. As described herein, other physical and/or chemical properties that can be switched in response to a stimuli can be contemplated in certain embodiments of the subject example method 600. At block 630, the heating element and the labeling element are assembled in order to form a thermal contact between such elements. For example, the labeling element can be adhesively attached to the heating element. For another example, the labeling element can be coated or otherwise deposited onto a surface of the heating element.

At block 640, it is determined if a specific operational condition (e.g., a fault condition, a high processing load condition, a near-threshold condition for a computing resource (such as available memory), or the like) of the component is present. As described herein, a control component (e.g., control unit 310) functionally coupled to the component can perform such determination. In a scenario in which it is ascertained that the specific operational condition is not present, flow of the example method 600 is re-directed to block 640 and the determining operation is re-implemented. Yet, in a scenario in which it is ascertained that the specific operational condition is present, flow is directed to block 650, at which the physical property of the labeling member is irreversibly switched via the suitable amount of heat. As described herein, by irreversibly switching the physical property of the labeling element, the specific operational condition can be conveyed. In one aspect, irreversibly switching the physical property via the suitable amount of heat in response to the specific operational condition can comprise supplying an electric signal (such as an electric current) to the heating element (e.g., element 230) via a conducting element (or conducting member, such as member 240) that is coupled to the heating element. For instance, the conducting element can be electrically coupled (e.g., soldered, glued, mounted, or otherwise attached in electrical contact) to an electrically resistive element contained in the heating element. It should be appreciated that, as described herein, the electric signal is suitable to cause the heating element to generate the suitable amount of heat. In an example embodiment in which the heating element (e.g., element 230) contains nichrome (e.g., a nichrome wire), application of about 3.5 Amp to an American wire gauge (AWG) 18 nichrome wire, for example, can raise the temperature of such wire to approximately 200 degrees Fahrenheit, which can permit change the color or other physical appearance of suitable paper embodying the labeling element. In an example scenario in which the operational condition is a fault condition and the physical property is optical absorption, switching from a first optical absorption spectrum (e.g., a first color) to a second absorption spectrum (e.g., a second color) in response to transferring the suitable amount of heat from the heating element to the labeling element, can visually represent the fault condition (or fault status) of the component. In view of the irreversibility of the switching, as described herein, a switched labeling element obtained from implementation of block 650 can provide a non-volatile representation of the specific operational condition.

Various advantages emerge from the present disclosure with respect to conventional technologies for maintenance and service of arrays of electronic computing device and components thereof. As an example advantage, the disclosure can provide visual information to a technician performing maintenance or servicing an electronic computing device that presents a fault condition. It is to be noted that the visual feedback associated with the faulty device remains available even after the device is de-energized and no longer available for analysis by other devices. As another example, reconfiguration or reinstallation of a device for representation of an operational state of an electronic component can be readily integrated into the workflow associated with maintenance and service of the electronic component in view that the device can be reset by replacing a labeling member (e.g., a thermal sticker) with an unused labeling member. As yet another advantage, the disclosure permit creating rich operational information indicative of performance of several electronic components or computing devices in complex computational environment without reliance on on-line performance information collection, and that is available after the computational environment is de-energized.

Unless otherwise expressly stated, it is in no way intended that any protocol, procedure, process, or method set forth herein be construed as requiring that its acts or steps be performed in a specific order. Accordingly, where a process or method claim does not actually recite an order to be followed by its acts or steps or it is not otherwise specifically recited in the claims or descriptions of the subject disclosure that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification or annexed drawings, or the like.

As used in this application, the terms "component," "environment," "system," "architecture," "interface," "unit," "module," and the like are intended to refer to a computer-related entity or an entity related to an operational apparatus with one or more specific functionalities. Such entities may be either hardware, a combination of hardware and software, software, or software in execution. As an example, a component may be, but is not limited to being, a process running on a processor, a processor, an object, an executable portion of software, a thread of execution, a program, and/or a computing device. For example, both a software application executing on a computing device and the computing device can be a component. One or more components may reside within a process and/or thread of execution. A component may be localized on one computing device or distributed between two or more computing devices. As described herein, a component can execute from various computer-readable non-transitory media having various data structures stored thereon. Components can communicate via local and/or remote processes in accordance, for example, with a signal (either analogic or digital) having one or more data packets (e.g., data from one component interacting with another component in a local system, distributed system, and/or across a network such as a wide area network with other systems via the signal). As another example, a component can be an apparatus with specific functionality provided by mechanical parts operated by electric or electronic circuitry that is controlled by a software application or firmware application executed by a processor, wherein the processor can be internal or external to the apparatus and can execute at least a part of the software or firmware application. As yet another example, a component can be an apparatus that provides specific functionality through electronic components without mechanical parts, the electronic components can include a processor therein to execute software or firmware that confers at least in part the functionality of the electronic components. An interface can include input/output (I/O) components as well as associated processor, application, and/or other programming components. The terms "component," "environment," "system," "architecture," "interface," "unit," "module" can be utilized interchangeably and can be referred to collectively as functional elements.

In the present specification and annexed drawings, reference to a "processor" is made. As utilized herein, a processor can refer to any computing processing unit or device comprising single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit (IC), an application-specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. A processor can be implemented as a combination of computing processing units. In certain embodiments, processors can utilize nanoscale architectures such as, but not limited to, molecular and quantum-dot based transistors, switches and gates, in order to optimize space usage or enhance performance of user equipment.

In addition, in the present specification and annexed drawings, terms such as "store," "storage," "data store," "data storage," "memory," "repository," and substantially any other information storage component relevant to operation and functionality of a component of the disclosure, refer to "memory components," entities embodied in a "memory," or components forming the memory. It can be appreciated that the memory components or memories described herein embody or comprise non-transitory computer storage media that can be readable or otherwise accessible by a computing device. Such media can be implemented in any methods or technology for storage of information such as computer-readable instructions, information structures, program modules, or other information objects. The memory components or memories can be either volatile memory or non-volatile memory, or can include both volatile and non-volatile memory. In addition, the memory components or memories can be removable or non-removable, and/or internal or external to a computing device or component. Example of various types of non-transitory storage media can comprise hard-disc drives, zip drives, CD-ROM, digital versatile disks (DVD) or other optical storage, magnetic cassettes, magnetic tape, magnetic disk storage or other magnetic storage devices, flash memory cards or other types of memory cards, cartridges, or any other non-transitory medium suitable to retain the desired information and which can be accessed by a computing device.

As an illustration, non-volatile memory can include read only memory (ROM), programmable ROM (PROM), electrically programmable ROM (EPROM), electrically erasable ROM (EEPROM), or flash memory. Volatile memory can include random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM). The disclosed memory components or memories of operational environments described herein are intended to comprise one or more of these and/or any other suitable types of memory.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

What has been described herein in the present specification and annexed drawings includes examples of systems, devices, and techniques that can provide structures and/or devices therefrom for representation of an operational state of an electronic device, an electromechanical device, a functional element (e.g., an electronic component), or equipment with electronic or electromechanical components or functional elements. It is, of course, not possible to describe every conceivable combination of elements and/or methods for purposes of describing the various features of the disclosure, but it can be recognize that many further combinations and permutations of the disclosed features are possible. Accordingly, it may be apparent that various modifications can be made to the disclosure without departing from the scope or spirit thereof. In addition or in the alternative, other embodiments of the disclosure may be apparent from consideration of the specification and annexed drawings, and practice of the disclosure as presented herein. It is intended that the examples put forward in the specification and annexed drawings be considered, in all respects, as illustrative and not restrictive. Although specific terms are employed herein, they are used in a generic and descriptive sense only and not for purposes of limitation.

What is claimed is:

1. A system, comprising:

a conducting member configured to transport an electric current to a heating member in response to a fault condition of an electronic component that is contained in an electronic computing device;

a solid-state substrate that is contained within circuitry of the electronic component;

the heating member is electrically coupled to the conducting member and the solid-state substrate, wherein the heating member is configured to receive at least a portion of the electric current and generate an amount of heat in response to at least the portion of the electric current; and a stationary labeling member removably attached to the heating member, the labeling member mounted to a planar surface of the heating member, wherein the labeling member has at least one physical property that is irreversibly switchable in response to at least the amount of heat that is generated by the heating member, wherein the labeling member is configured to convey information specific to the fault condition, and wherein the information is conveyed via at least one of a one-dimensional barcode, a two-dimensional barcode, a universal product code, or a matrix code.

2. The system of claim 1, wherein the heating member comprises an electrically resistive member that generates the amount of heat in response to the electric current being transported there through in response to the fault condition of the electronic component, and wherein the at least one physical property comprises one or more of optical absorption, optical emission, or reflectance.

3. The system of claim 2, wherein the heating member is configured to generate the amount of heat at a localized region of the solid-state substrate.

4. The system of claim 1, wherein the labeling member comprises a flexible solid-state film that is configured to be peeled off from the heating member.

5. A device, comprising:

a conducting member;

a solid-state substrate abutting a surface of a structure attached to an electronic device, the substrate produces a stimulus in response to a transition to a predetermined operational condition of an electronic component that is contained in the electronic computing device, wherein the substrate is contained within circuitry of the electronic computing device and comprises an electrically resistive member that produces at least a portion of the stimulus in response to the transition to the predetermined operational condition of the electronic computing device, and wherein the electrically resistive member is electrically coupled to the conducting member; and a stationary labeling member removably mounted to the substrate and having at least one physical property that is irreversibly modified in response to the stimulus produced by the substrate, wherein the labeling member is configured to convey information specific to the predetermined operational condition, and wherein the information is conveyed via at least one of a one-dimensional barcode, a two-dimensional barcode, a universal product code, or a matrix code.

6. The device of claim 5, wherein the at least one physical property comprises one or more of optical absorption, optical emission, or reflectance, and wherein the at least one physical property is irreversibly switchable in response to the at least the portion of the stimulus.

7. The device of claim 5, wherein the electrically resistive member is configured to produce the at least the portion of the stimulus at a localized region of the substrate.

8. The device of claim 7, wherein the labeling member is removably attached to the substrate in a region spanning at least a portion of the localized region.

9. The device of claim 8, wherein the labeling member comprises a flexible solid-state film that is configured to be released from the substrate.

10. The device of claim 5, wherein the substrate and the labeling member form a monolithic solid-state structure.

11. A system, comprising:

a plurality of structural members, wherein a first structural member of the structural members is associated with a first electronic component that is contained in an electronic computing device and a second structural member of the structural members is associated with a second electronic component that is contained in the electronic computing device;

a first solid-state substrate abutting a first surface of the first structural member;

a second solid-state substrate abutting a second surface of the second structural member;

a first heating member attached to the first structural member, the first heating member configured to generate a first amount of heat in response to a first predetermined operational condition of the first electronic component;

a second heating member attached to the second structural member, the second heating member configured to generate an a second amount of heat in response to a second predetermined operational condition of and the second electronic component;

a first stationary labeling member thermally coupled to the first heating member and removably attached to of the first heating member, the first labeling member abutting a first planar surface of the first heating member and having at least one first physical property configurable in response to the first amount of heat, wherein the first labeling member is configured to convey first information specific to the first predetermined operational condition, and wherein the first information is conveyed via at least one of a one-dimensional barcode, a two-dimensional barcode, a universal product code, or a matrix code; and a second stationary labeling member thermally coupled to the second heating member and removable attached to the second heating member, the second labeling member abutting a second planar surface of the second heating member and having at least one second physical property configurable in response to the second amount of heat, wherein the second labeling member is configured to convey second information specific to the second predetermined operational condition, and wherein the second information is conveyed via at least one of a one-dimensional barcode, a two-dimensional barcode, a universal product code, or a matrix code.

12. The system of claim 11, wherein the structural members are arranged in a predetermined configuration.

13. A method, comprising:

providing a labeling element having a physical property that is irreversibly switchable by a defined amount of heat;

providing a heating element configured to provide the defined amount of heat;

providing a solid-state substrate that is contained within circuitry of an electronic component, wherein the electronic component is contained in an electronic computing device;

assembling the heating element, the solid substrate, and the labeling element to form a thermal contact therebetween, wherein the label element is stationary with respect to the heating element;

detecting, at an electronic device, a defined operational condition of the electronic component having a structural member coupled to the heating element; and irreversibly switching the physical property via the defined amount of heat resulting in an indication of the defined operational condition, wherein the labeling element is configured to convey information specific to the defined operational condition, and wherein the information is conveyed via at least one of a one-dimensional barcode, a two-dimensional barcode, a universal product code, or a matrix code.

14. The method of claim 13, wherein the irreversibly switching the physical property comprises supplying an electric signal, by the electronic device, to the heating element via a conducting member coupled thereto, the electric signal causes the heating element to generate the defined amount of heat.

* * * * *